US007641263B2

(12) United States Patent
Ruslanov et al.

(10) Patent No.: US 7,641,263 B2
(45) Date of Patent: Jan. 5, 2010

(54) VEHICLE DESIGNER (VARIANTS)

(75) Inventors: Aleksandr Semenovich Ruslanov, Varshavskoe shosse, 152-6-148, Moscow (RU) 113405; Aleksandr Georgievich Soldatov, Moscow (RU); Aleksandr Mikhailovich Shilov, Moscow (RU)

(73) Assignee: Aleksandr Semenovich Ruslanov, Moscow (RU)

( * ) Notice: Subject to any disclaimer, the term of this patent is extended or adjusted under 35 U.S.C. 154(b) by 122 days.

(21) Appl. No.: 11/815,864

(22) PCT Filed: Mar. 30, 2005

(86) PCT No.: PCT/RU2005/000149

§ 371 (c)(1),
(2), (4) Date: Aug. 8, 2007

(87) PCT Pub. No.: WO2006/107229

PCT Pub. Date: Oct. 12, 2006

(65) Prior Publication Data

US 2008/0143141 A1 Jun. 19, 2008

(51) Int. Cl.
*B62D 33/00* (2006.01)

(52) U.S. Cl. ..... 296/181.1; 446/470; 446/471

(58) Field of Classification Search ..... 296/181.1; 446/470, 471

See application file for complete search history.

(56) References Cited

U.S. PATENT DOCUMENTS

| | | | | |
|---|---|---|---|---|
| 6,918,627 | B2 * | 7/2005 | Mataja et al. | 296/177 |
| 7,100,968 | B2 * | 9/2006 | Mataja et al. | 296/177 |
| 2005/0287925 | A1 * | 12/2005 | Proch et al. | 446/470 |
| 2007/0111635 | A1 * | 5/2007 | Tooby et al. | 446/471 |

* cited by examiner

*Primary Examiner*—Lori L Lyjak
(74) *Attorney, Agent, or Firm*—patenttm.us

(57) ABSTRACT

In the first variant, a designer set of elements is embodied in such a way that it makes it possible to shape different modifications of a passenger car body. The body is embodied such that it is splitable on a transversal plane. The element set consists of changeable front and rear elements. In the body split plane, the external surfaces of all front and rear elements have the same shapes and sizes. In the second variant, the body is splitable in two transversal planes. The body element set consists of changeable hood, cab and body rear part elements, wherein the external surfaces of the elements are smoothly mating with each other.

13 Claims, 5 Drawing Sheets

VEHICLE DESIGNER (VARIANTS)

FIELD OF THE INVENTION

The invention relates to designer sets and may be used for modeling various modifications of passenger vehicles including cars, minivans and buses.

BACKGROUND OF THE INVENTION

A vehicle designer set is known that comprises a chassis, a set of elements intended for installing on the chassis with the possibility of replacing elements for the purpose of designing various modifications of vehicles, and retainers made with the possibility of attaching said elements to the said chassis (German application No. 3244061, A 63 H 33/10, publ. 1984).

The above designer set is intended for modeling various special-purpose vehicles and trucks, e.g., haulers having a body, dozers, asphalt compactors, etc. A set of elements is usually used for modeling such vehicles, namely, a driver's cab and various mounted implements, such as a rectangular body for carrying cargoes, a bucket, a drum, etc. Retainers are made in the form of pins fastened to round or rectangular plates. Pins are installed into mating parts of a body, thus providing proper connection of parts in the parting plane.

The main limitation of the said set is the impossibility of designing various modifications of passenger vehicles, since the structure does not provide for making alterations in the form of a driver's cab. Though it is possible to change the appearance of a vehicle by replacing various attachments available in the set, the overall attractiveness of an assembled vehicle is not very high, since a visual image of a vehicle provided with various attachments to a driver's cab having the same appearance and form is easily foreseen. A great number of elements used enables to create only a limited number of models. Moreover, retainers available in the set are installed from the outside, which results in an unjustified change in the appearance of a vehicle, and during assembling it is difficult to create modifications of vehicles (even trucks and special purpose vehicles) that would be similar to real ones.

SUMMARY OF THE INVENTION

The objective of this invention is to create variants of a vehicle designer set, which would ensure higher attractiveness, the possibility of changing a design of a passenger vehicle appearance according to a wish of a consumer, more models of a vehicle while minimizing a number of elements used for making it, creation of passenger vehicles having an appearance similar to that of real vehicles, and creation of vehicles having an original imaginary appearance, provision of a possibility for a child of studying various relations of proportions and forms of designs, their beauty and elegance or incompatibility and clumsiness, so that to ensure a possibility of modeling passenger vehicles (cars and buses) having a completely different appearance.

In order to achieve the said objective according to the first embodiment, a vehicle designer set comprising a chassis, a set of elements intended for installing on the chassis with the possibility of replacing elements for the purpose of modeling different modifications of vehicles, retainers made with the possibility of attaching elements to the chassis, the set of elements according to the claimed invention is made so as to ensure modeling of a body for different modifications of a passenger vehicle, a passenger vehicle body is made splittable in a transverse plane, and the set of body elements is made of, at least, four elements, namely, two interchangeable front elements and two interchangeable rear elements, the outer surfaces of all the front and rear elements in the parting plane of a passenger vehicle body being made so as to have a similar form and similar size, wherein at least a portion of the said similar form being made curvilinear with the possibility of smoothly mating the outer surface of a front element to the outer surface of a rear element when said elements are installed on the chassis.

Additional embodiments of the claimed set are possible, wherein it is expedient that:

- said retainers are made as resilient latches located inside a body;
- said retainers are made as a threaded connection between the chassis and the body, which connection is located inside the body.

In order to achieve the said objective according to the first embodiment, a vehicle designer set comprising a chassis, a set of elements intended for installing on the chassis with the possibility of replacing elements for the purpose of modeling different modifications of vehicles, retainers made with the possibility of attaching elements to the chassis, the set of body elements according to the claimed invention is made so as to ensure modeling of different modifications of a passenger vehicle, a passenger vehicle body is made splittable in two transverse planes, and the set of body elements is made of, at least, six elements, namely, two hood elements, two cab elements and two elements of the rear part of a body, providing the possibility of interchanging the hood elements therebetween, the possibility of interchanging the cab elements therebetween, and, respectively, the possibility of interchanging the elements of the rear part of a body therebetween, in one parting plane of a passenger vehicle body the outer surfaces of all the hood elements and all the cab elements being made so as to have a similar form and similar size, wherein at least a portion of the said similar form being made curvilinear with the possibility of smoothly mating the outer surface of a hood element to the outer surface of a cab element, and in the other parting plane of a passenger vehicle body the outer surfaces of all the cab elements and all the elements of the rear part of a body being made so as to have a similar form and similar size, wherein at least a portion of the said similar form being made curvilinear with the possibility of smoothly mating the outer surface of a cab element to the outer surface of an element of the rear part of a body when the said elements are installed on the chassis.

Additional embodiments of the claimed set are possible, wherein it is expedient that:

- said cab elements are made equal in length along the longitudinal axis;
- the said chassis is made splittable in a transverse plane and consists of, at least, a set of three parts, wherein one part of the said set having a greater length along the body longitudinal axis than another part and is intended for replacing it;
- the said chassis is made splittable in a transverse plane and consists of, at least, a set of three parts, wherein one part of the said set is intended for increasing the chassis length along the body longitudinal axis when it is installed between the other two parts.

In addition to the above two variants:

- the cab elements may be made so as to have different lengths;
- the chassis may be provided with retaining elements for fixing mating parts of the chassis.

Moreover, in addition to the last variant, the chassis retaining elements may be made in the form of resilient latches.

Both main variants solve one and the same task and have an essential feature not known in the art and included into both variants; they, therefore, form a single inventive concept.

The above advantages as well as the specific features of this invention are further explained by its preferred embodiments with references to the appended drawings.

DESCRIPTION OF PREFERRED EMBODIMENTS

Figure 1:
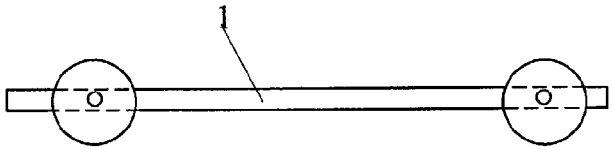
FIG. 1 is a schematic representation of the chassis.
Figure 2:
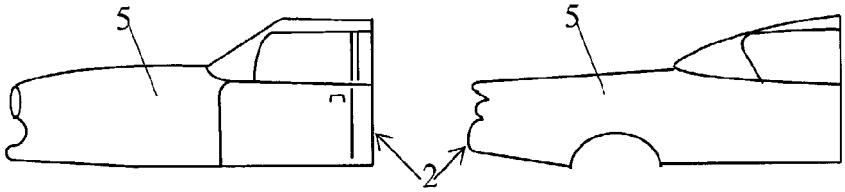
FIG. 2 depicts the front elements of the inventive designer set.
Figure 3:
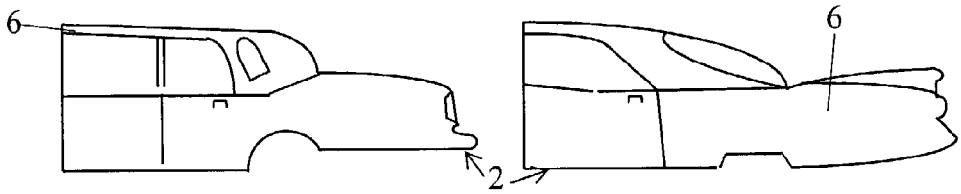
FIG. 3 depicts the rear elements of the inventive designer set.

The vehicle designer set (FIG. 1) according to the first embodiment comprises a chassis 1. A set 2 of elements is intended for installation on the chassis 1 with the possibility of replacing elements for the purpose of modeling different modifications of vehicles. Retainers 3 (FIG. 5, 6) are made with the possibility of attaching elements to the chassis 1.

Figure 4:
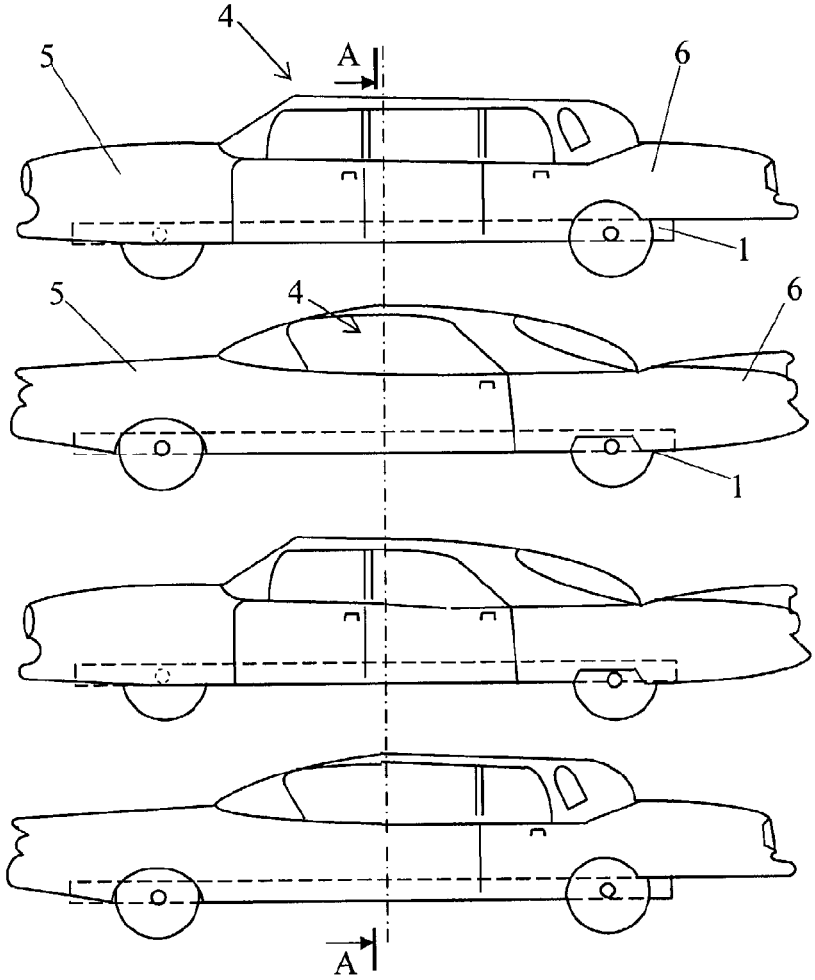
FIG. 4 shows (schematically) different variants of the assembled structures according to the first embodiment.
Figure 5:
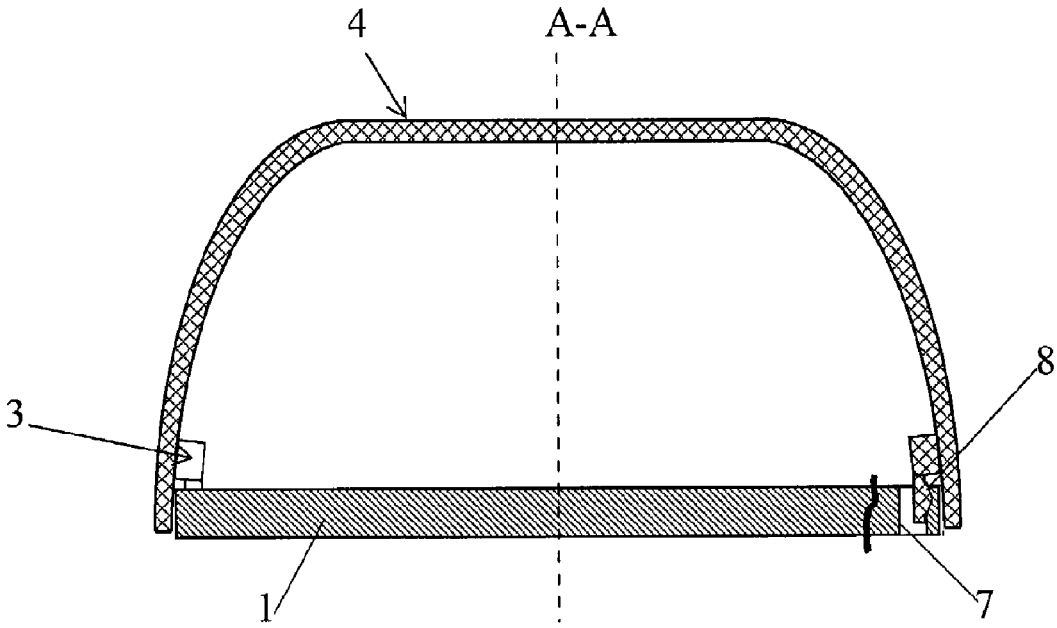
FIG. 5 shows A-A section for each of the models shown on FIG. 4.
Figure 6:
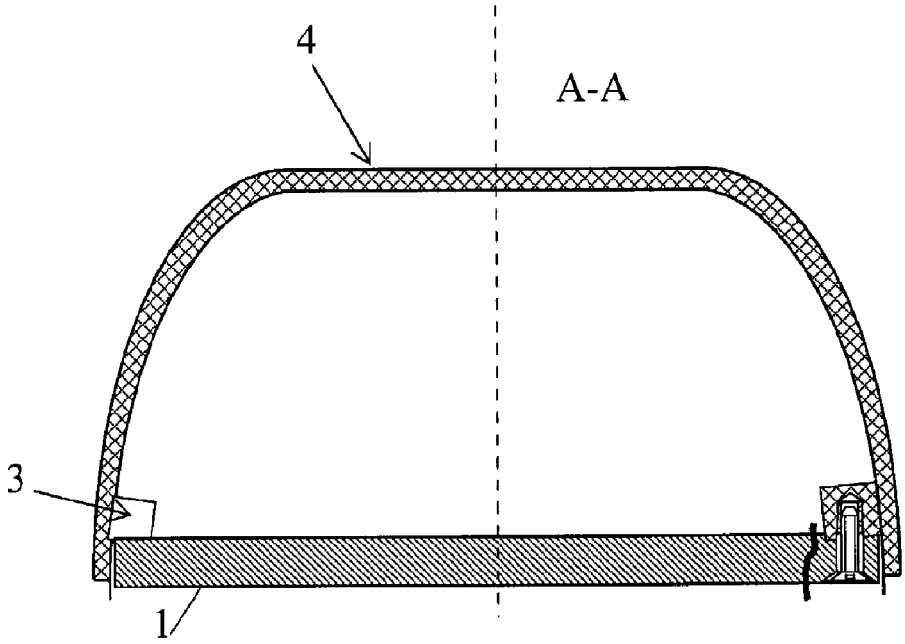
FIG. 6—the same as FIG. 5, another variant of connecting the body and the chassis.

The set 2 of elements (FIG. 1) is made so as to ensure modeling a body 4 for different modifications of a passenger vehicle (FIG. 4). The body 4 of a passenger vehicle is made splittable in a transverse plane (along the chain line A-A (FIG. 4). The set 2 of elements for the body 4 is made of at least four elements, namely, the two front elements 5 and the two rear elements 6, with the possibility of interchanging the front elements 5 therebetween and the rear elements 6 therebetween. In the parting plane A-A of the body 4 of a passenger vehicle the outer surfaces of all the front and rear elements 5, 6 are made so as to have a similar form and size (FIGS. 5, 6). At least a portion of the said similar form of the front and rear elements 5, 6 in the sectional plane A-A is made curvilinear with the possibility of smoothly mating (passing) the outer surface of a front element 5 to the outer surface of a rear element 6 when they are installed on the chassis 1.

Smooth mating of the outer surface of a front element 5 to the outer surface of a rear element 6 is understood as a gapless transition, i.e., a transition gradually passing from one position of an outer surface to another. That is, the outer surfaces of a front element 5 and a rear element 6, when they are installed on the chassis 1, mate each other uniformly, without abrupt visual transitions and steps.

The retainers 3 (FIG. 5) may be made as resilient latches located inside the body 4. For example, a slot 7 with a valley is made for this purpose in the plate of the chassis 1, and the lug of the resilient element, which is fixed inside the housing of the body 4, comes into it. Latches may have various forms and ensure easy assembly. Such a connection may be used in a designer set intended for children of younger age.

The retainers 3 (FIG. 6) may be made as a threaded connection between the chassis 1 and the body 4. The threaded connection is located inside the body 4. Such a connection may be used in a designer set intended for children of senior age.

But the most interesting is the second main embodiment of the inventive set, wherein the vehicle designer set (FIG. 7) comprises a chassis 1, a set of elements intended for installation on the chassis 1 with the possibility of replacing elements for the purpose of modeling different modifications of vehicles. Retainers 3 are made with the possibility of attaching the elements to the chassis 1 (they are not shown on FIG. 7 and may be made similar to those shown on FIGS. 5 and 6).

A set of elements for a body 4 is made so as to ensure modeling different modifications of a passenger vehicle. The body 4 of a passenger vehicle is made splittable in two transverse planes B-B and C-C (shown by chain lines on FIG. 7). The set of elements for the body 4 is made of at least six elements, namely, two hood elements 9, two cab elements 10, and two elements 11 of the rear part of the body 4. The elements 9, 10, 11 are made with the possibility of interchanging therebetween. In the parting plane B-B of the body 4 of a passenger vehicle the outer surfaces of all the hood elements 9 and all the cab elements 10 are made so as to have a similar form and size (FIGS. 5, 6), wherein at least a portion of the said similar form is made curvilinear with the possibility of smoothly mating the outer surface of a hood element 9 to the outer surface of a cab element 10. In the other parting plane C-C of the body 4 the outer surfaces of all the cab elements 10 and all the elements 11 of the rear part of the body 4 are made so as to have a similar form and size, wherein at least a portion of the said similar form is made curvilinear with the possibility of smoothly mating the outer surface of a cab element 10 to the outer surface of an element 11 of the rear part of the body 4 when that are installed on the chassis 1.

Smooth mating of the outer surface of an element 9 to the outer surface of an element 10, and smooth mating of the outer surface of an element 10 to the outer surface of an element 11 is understood as a gapless transition, i.e., a transition gradually passing from one position of an outer surface to another. That is, the outer surfaces of elements 9, 10, 11, when they are installed on the chassis, mate each other uniformly, without abrupt visual transitions and steps. On the parting planes B-B and C-C, when the outer surfaces are mated, formation of only obtuse angles is possible in cross-sections along the longitudinal axis of the body (see, e.g., the transition of the hood to the front window on FIG. 7) or angles 180°, i.e., the outer surfaces in cross-section transversal planes pass to each other along straight lines (see, for example, the transition of a fender to a cab door on FIG. 7), but formation of right angles or acute angles in cross-sections is impossible. In any case, smooth mating in a passenger vehicle ensures fairness of its form.

Figure 7:
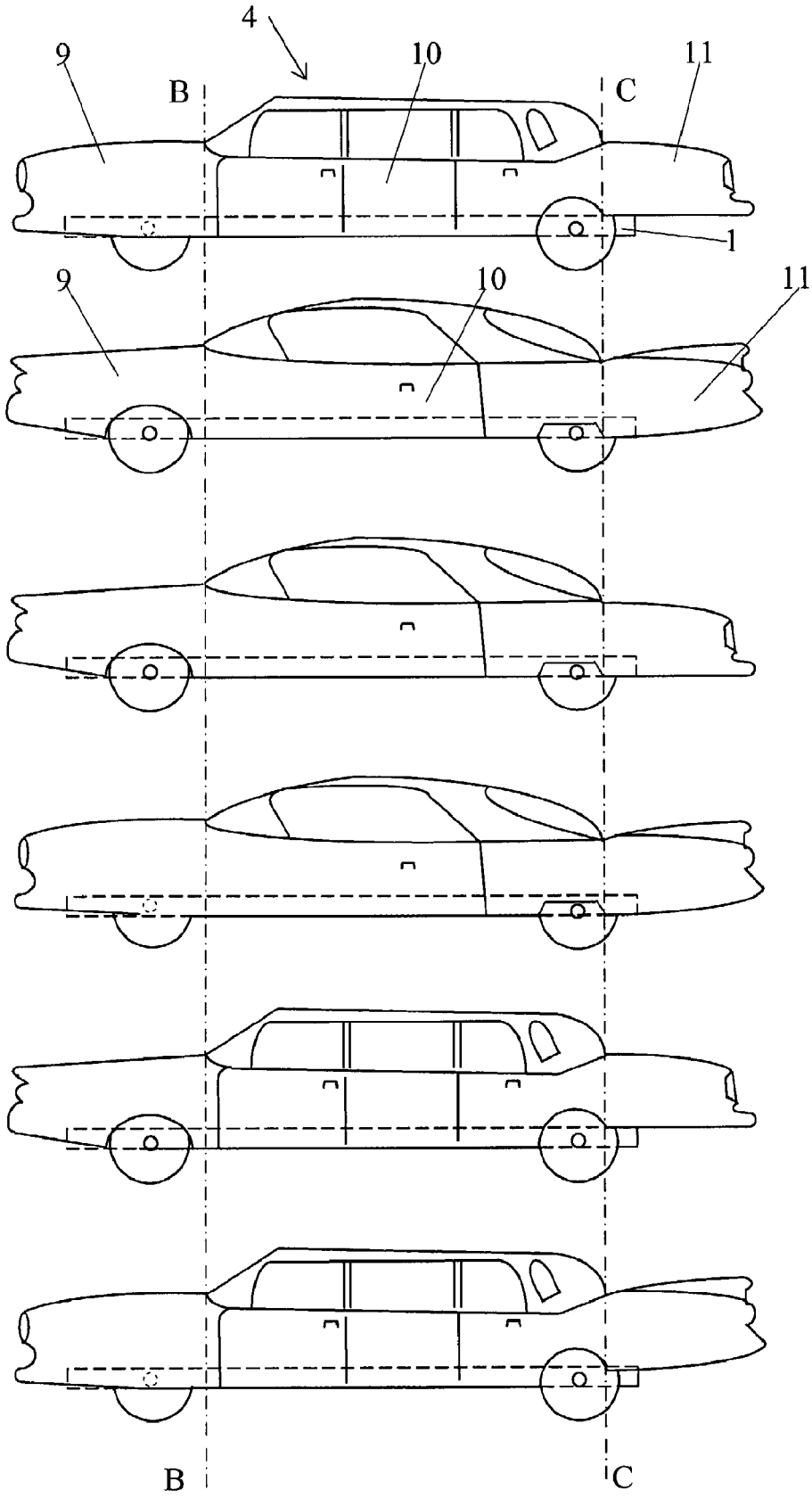
FIG. 7 shows (schematically) different variants of assembled structures according to the second embodiment.

The cab elements 10 may be made so as to have equal lengths along the longitudinal axis (FIG. 7).

Figure 8:
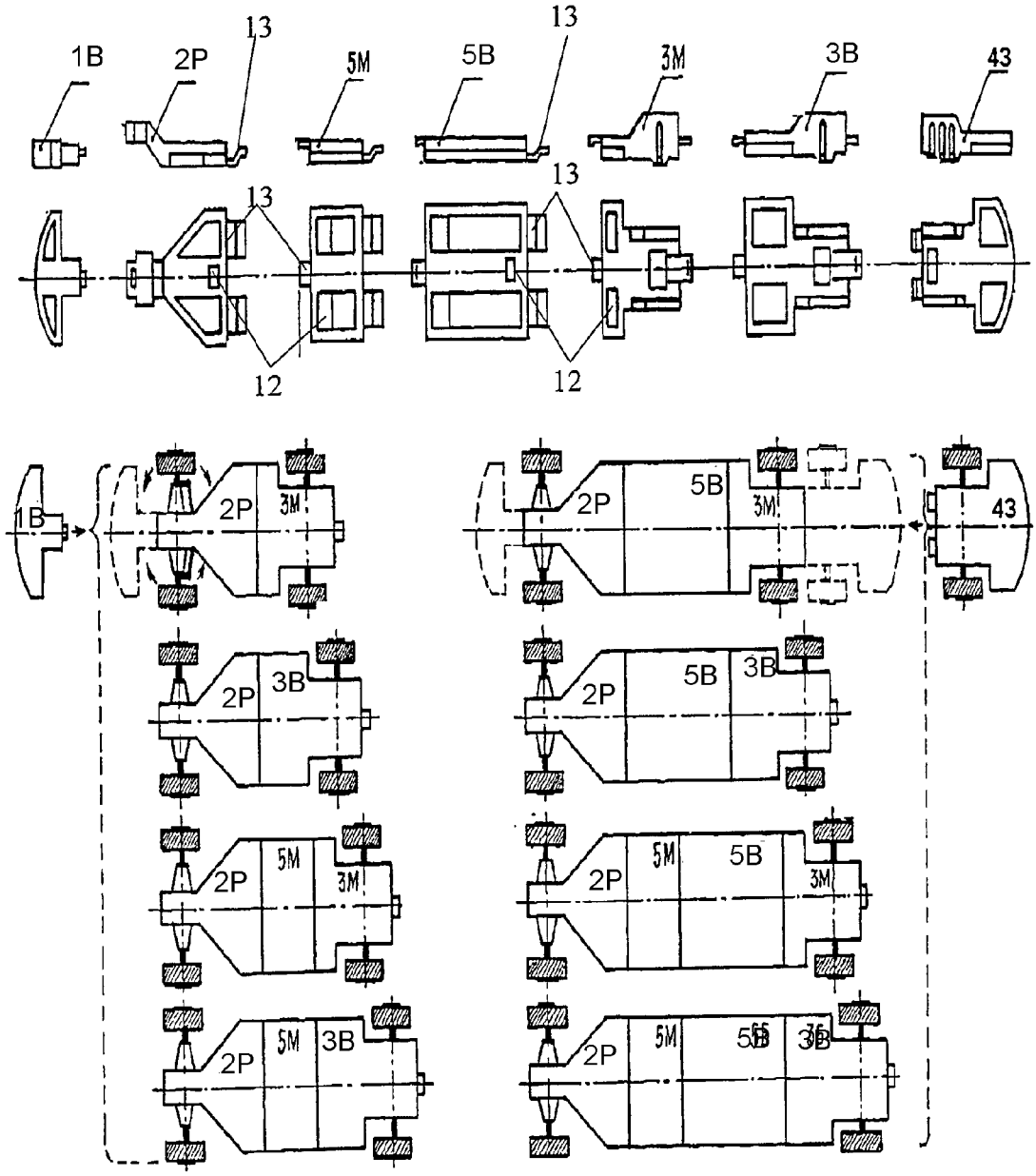
FIG. 8 shows separate parts of the chassis according to the second embodiment.

FIG. 8 shows the inventive set of parts for a splittable chassis 1, where, for the sake of brevity, the following designations are used: 1B—a bumper element, 2F—the front part of the chassis 1, 5S—a small insert of the chassis 1, 5L—a large insert of the chassis 2, RS—the rear small part of the chassis 1, RL—the rear large part of the chassis 1, 431'the rear part when a structure with two rear wheels is used. The first upper row of parts—a side view of detachable elements of the chassis 1, the second upper row of parts—a top view of detachable elements of the chassis 1, the following lower rows—possible variants of connecting detachable elements of the chassis 1 therebetween.

The chassis 1 may be made splittable on a transverse plane and comprise, at least, a set of three parts (FIG. 8), wherein one part of the set having a greater length along the longitudinal axis of the body 4 than another part and is intended for replacing it. It is shown on FIG. 8 by the top assembled view, the first and the second structures in the vertical row. The part RS is subsequently replaced by the part RL.

The chassis 1 may be made splittable on a transverse plane and comprise, at least, a set of three parts, wherein one part of the set being intended for increasing the chassis length along the longitudinal axis of the body 4 when that part is installed between the other two parts. On the following drawings the part 5S is installed between the part 2F and the part RS, the part 5S is installed between the part 2F and the part RL, the part 5L is installed between the part 2F and the part RS, etc.

The above variants enable to increase the length of the chassis 1 and the distance between wheel axes.

Figure 9:
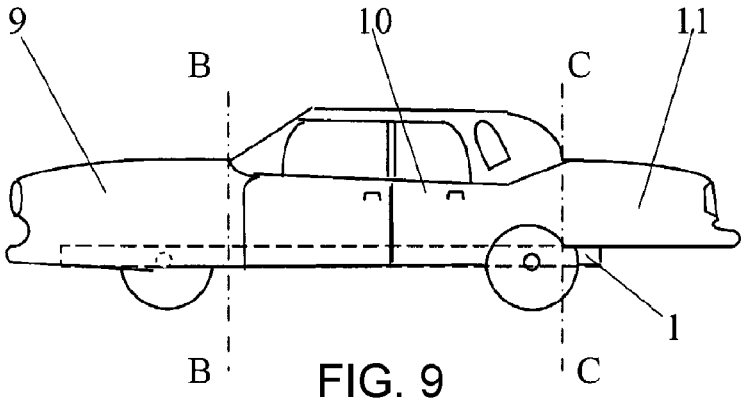
FIG. 9 shows a vehicle model with a shortened cab element.
Figure 10:
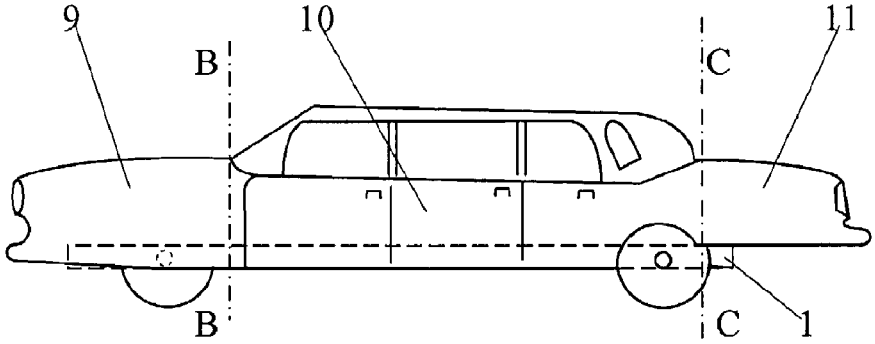
FIG. 10 shows a vehicle model with a cab element of a medium length.
Figure 11:
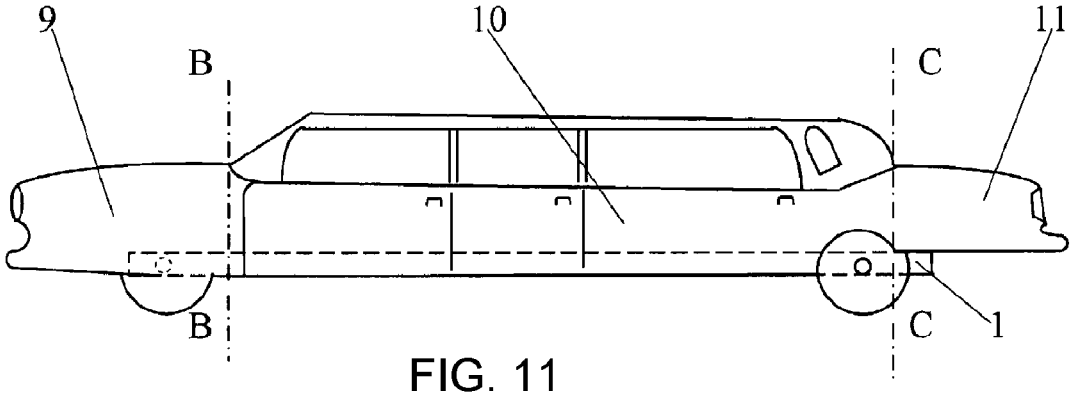
FIG. 11 shows a vehicle model with an elongated cab element.

In accordance with the above changes the cab elements 10 may be made so as to have different lengths (FIGS. 9, 10, 11). For example, the cab element 10 (FIG. 9) is assembled on the basis of the chassis 1 made of the parts 2F and RL (FIG. 8). The cab element 10 (FIG. 10) is assembled on the basis of the parts 2F, 5S, RL (FIG. 8). The cab element 10 (FIG. 11) is assembled on the basis of the parts 2F, 5B, RL (FIG. 8).

The chassis 1 is provided with retaining elements for attaching various mating parts of the chassis. The retaining elements may be made, in particular, in the form of resilient latches. For this purpose openings 12 are made in the chassis parts, and lugs 13, which are identical as to their locations and forms, are made along the longitudinal axis for each of the parts. Thus, individual parts of the chassis 1 may be easily interchanged and connected therebetween.

The operation of the set may be described as follows.

According to the first variant of making a device (FIG. 1-6) a consumer interchanges individual elements of the body, thus creating different models and modifications of vehicles. It can be seen on FIG. 4 that the availability of four elements in the set 2 enables to create only four vehicles, but if the set 2 comprises six elements, namely, three front elements 5 and three rear elements 6, the number of vehicle models is 9, etc.

The number K of vehicle models that may be created depends on the number n of the elements in the set 2, the number of the front elements 5 being equal to the number of the rear elements 6, and is bound to the relation $K=(n/2)$. For the four front elements 5 and the four rear elements 6 (i.e., eight elements in total) $\kappa=(8/2)^2=16$. If n=10, κ=25; if n=12, K=36, etc. Thus, if the set 2 comprises twenty elements (ten front elements 5 and ten rear elements 6) one hundred vehicle models may be assembled.

Unlimited possibilities for art design are provided by a variant using two parting planes of the body 4—B-B and C-C (FIG. 7) and having a splittable chassis 1 (FIG. 8). This variant enables, even with minimum number of parts, randomly change appearance (FIG. 7), length of the body 4 (FIG. 8), thus ensuring creation of absolutely different models of passenger vehicles. Individual, made accordingly, elements 9, 10, 11 enable creating bodies 4 of passenger vehicles having an appearance close to reality, e.g., of sedan, station wagon, hatchback, coupe, etc. At the same time, by changing the length of the body 4 (FIG. 9-11), a consumer may create vehicles having an original appearance. When assembling a vehicle, children are able to assess relations between proportions and forms of different designs. They, while being involved in the process of assembling a vehicle, learn how to form a single style of a vehicle, identify characteristic features of vehicles existing in reality or manufactured by various companies, as well as create new appearances of vehicles.

INDUSTRIAL APPLICABILITY

The claimed designer set may be most successfully applied for creatively designing passenger vehicles, such as cars, minivans, buses that may significantly differ by their appearance.

What is claimed is:

1. A vehicle designer set comprising a chassis, a set of elements intended for installing on said chassis with the possibility of replacing elements for the purpose of modeling different modifications of vehicles, retainers made with the possibility of attaching elements to said chassis, characterized in that said set of elements is made so as to ensure modeling a body for different modifications of passenger vehicles, said body of a passenger vehicle is made splittable on a transverse plane, and said set of elements for a body is made so as to comprise at least four elements, namely, two interchangeable front elements and two interchangeable rear elements, the outer surfaces of all said front and rear elements in the parting plane of a passenger vehicle body being made so as to have a similar form and similar size, and at least a portion of said similar form being made curvilinear with the possibility of smoothly mating the outer surface of a front element to the outer surface of a rear element when said elements are installed on the chassis.

2. A designer set according to claim 1, characterized in that said retainers are made in the form of resilient latches located inside said body.

3. A designer set according to claim 1, characterized in that said retainers are made in the form of threaded connection between the chassis and the body, which is located inside the body.

4. A vehicle designer set comprising a chassis, a set of elements intended for installing on said chassis with the possibility of replacing elements for the purpose of modeling different modifications of vehicles, retainers made with the possibility of attaching elements to said chassis, characterized in that said set of body elements is made so as to ensure modeling different modifications of passenger vehicles, said body of a passenger vehicle is made splittable on two transverse planes, and said set of elements for a body is made so as to comprise at least six elements, namely, two interchangeable hood elements, two interchangeable cab elements and two interchangeable elements of the rear part of a vehicle, the outer surfaces of all said hood elements and all said cab elements in one parting plane of a passenger vehicle body being made so as to have a similar form and similar size, and at least a portion of said similar form being made curvilinear with the possibility of smoothly mating the outer surface of a hood element to the outer surface of a cab element, and in the other parting plane of the body of a passenger vehicle the outer surfaces of all the cab elements and the outer surfaces of all the elements of the rear part of the body being made so as to have a similar form and similar size, and at least a portion of said similar form being made curvilinear with the possibility of smoothly mating the outer surface of a cab element to the outer surface of an element of the rear part of the body when said elements are installed on the chassis.

5. A designer set according to claim 4, characterized in that said cab elements are made equal in length along the longitudinal axis.

6. A designer set according to claim 4, characterized in that said chassis is made splittable in a transverse plane and comprises, at least, a set of three parts, one part of said set having a greater length along the body longitudinal axis than the others.

7. A designer set according to claim 4, characterized in that said chassis is made splittable in a transverse plane and comprises, at least, a set of three parts, one part of said set being intended for increasing the chassis length along the body longitudinal axis when one part of said set is installed between the other two parts instead of the removed part.

8. A designer set according to claim 7, characterized in that the cab elements are made so as to have different lengths.

9. A designer set according to claim 7, characterized in that the chassis is provided with retaining elements used for attaching the mating parts of the chassis.

10. A designer set according to claim 9, characterized in that said retaining elements are made in the form of resilient latches.

11. A designer set according to claim 6, characterized in that the cab elements are made so as to have different lengths.

12. A designer set according to any of claim 6, characterized in that the chassis is provided with retaining elements used for attaching the mating parts of the chassis.

13. A designer set according to claim 12, characterized in that said retaining elements are made in the form of resilient latches.

* * * * *